US005530211A

United States Patent [19]

Rogers et al.

[11] Patent Number: 5,530,211

[45] Date of Patent: Jun. 25, 1996

[54] SOUND REFLECTING SHELL TOWER AND TRANSPORTER STRUCTURE AND METHODS OF ERECTING AND STORING THE TOWERS

[75] Inventors: Orley D. Rogers, Farwell, Mich.; James F. Jenne, Palos Verdes, Calif.; Phillip R. Blaisdell, Farwell, Mich.

[73] Assignee: Stageright Corporation, Clare, Mich.

[21] Appl. No.: 364,319

[22] Filed: Dec. 27, 1994

Related U.S. Application Data

[62] Division of Ser. No. 89,309, Jul. 8, 1993, abandoned.

[51] Int. Cl.[6] ..... E04B 1/99

[52] U.S. Cl. ..... 181/30; 160/135

[58] Field of Search ..... 181/30, 285, 287, 181/292, 295, 296; 160/135

[56] References Cited

U.S. PATENT DOCUMENTS

| | | | |
|---|---|---|---|
| 1,896,844 | 2/1933 | Hanson | 181/30 |
| 3,007,539 | 11/1961 | Brewers et al. | 181/30 |
| 3,180,446 | 4/1965 | Wenger | 181/30 |
| 3,232,370 | 2/1966 | Jaffe | 181/30 |
| 3,435,909 | 4/1969 | Wenger et al. | 181/30 |
| 3,630,309 | 6/1969 | Wenger | 181/30 |
| 3,908,787 | 9/1975 | Wenger et al. | 181/30 |
| 4,278,145 | 7/1981 | Eade et al. | 181/30 |
| 5,069,011 | 12/1991 | Jenne | 160/135 X |
| 5,403,979 | 4/1995 | Rogers et al. | 181/30 |

*Primary Examiner*—Khanh Dang
*Attorney, Agent, or Firm*—Learman & McCulloch

[57] ABSTRACT

An orchestra shell tower and tower transporter system has a plurality of shell towers comprising an acoustic central panel hingedly connected along its side edges to acoustic wing panels. A generally horizontally rearwardly extending tripod-shaped open base is fixed to the lower end of the central panel and counterweights both the central panel and the wing panels. Vertically adjustable dependent legs with stage engaging members are provided on the tower. A tower transporter has a forwardly extending tripod-shaped open base supported on caster wheels and configured to be received within the base of each of the shell towers. Vertically movable lifters on the transporter base have receptors for engaging the legs of each of the tower shells in lifting relationship and actuatable motors are provided on the transporter for raising and lowering the lifters, and thereby the tower engaged by the transporter for supporting the tower in a raised position for travel. The wing panels are fully folded after the shell tower reaches a position for storage and, as the successive towers are brought to the storage position, they are successively nested one with the other. Locking mechanism holds the tower wing panels in folded positions and in the user positions in which they substantially facially align with the central panel.

14 Claims, 14 Drawing Sheets i
59
T
20
58
TM
h
g
f
PA
e
21
d
c
b
a
22
58a
21
BF
13
22

FIG-5
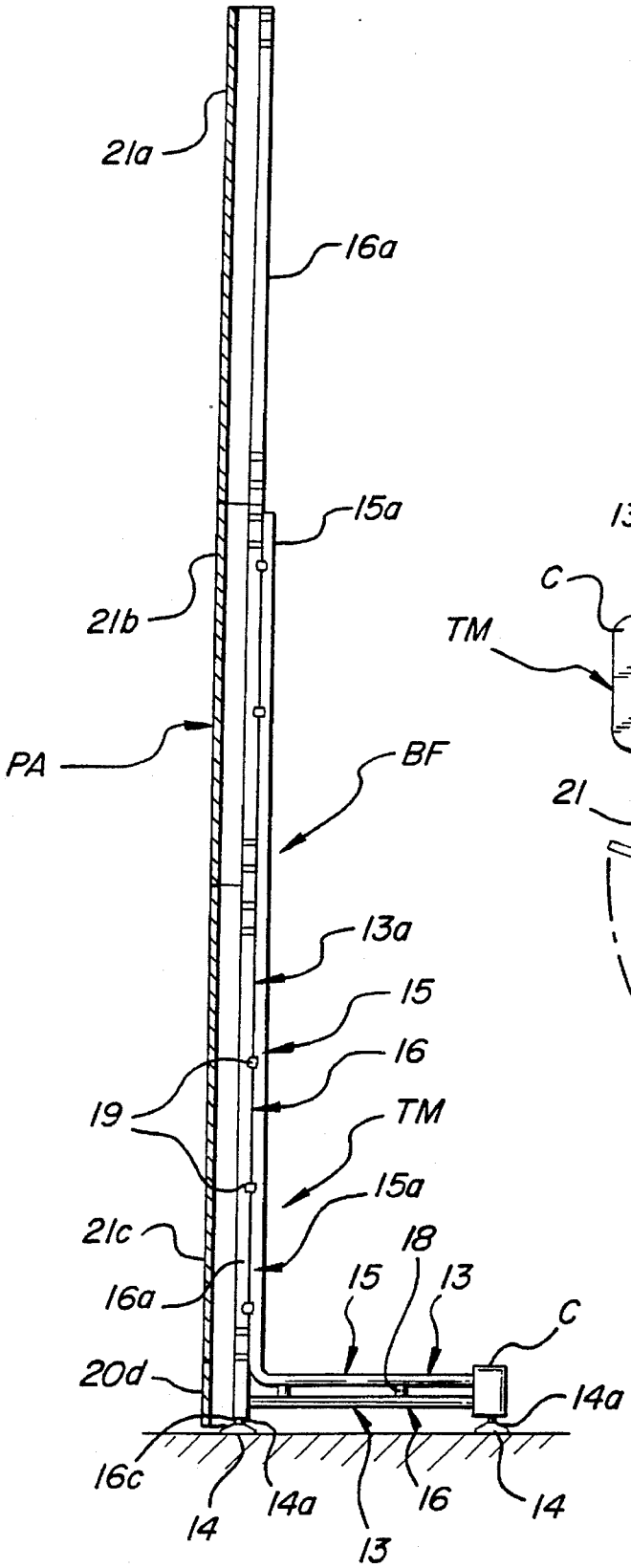
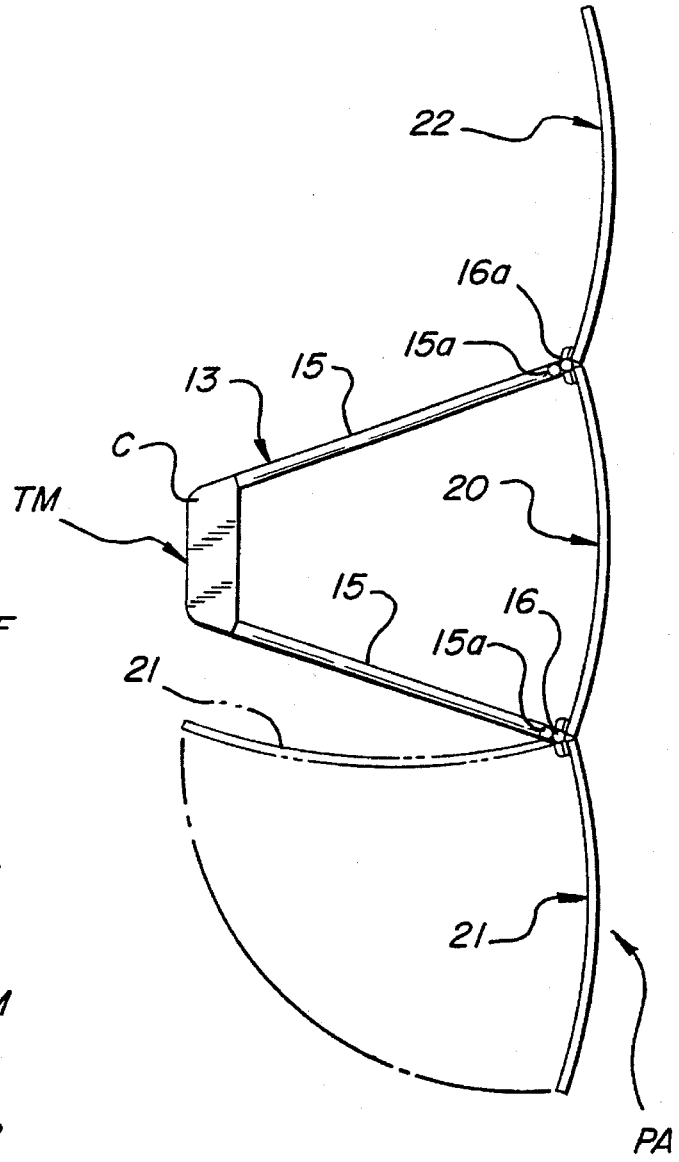
FIG-7

SOUND REFLECTING SHELL TOWER AND TRANSPORTER STRUCTURE AND METHODS OF ERECTING AND STORING THE TOWERS

This is a divisional of application Ser. No. 08/089,309 filed on Jul. 8, 1993, now abandoned.

BACKGROUND OF THE INVENTION

This invention relates to self-standing, sound-reflective shell tower and shell tower transporter systems wherein the towers are of the type which are used on stage to enhance the performance of orchestras, bands, choruses and dramatic groups. Such acoustical shells typically comprise a plurality of movable panel modules which are placed in side by side relation in abutting relationship to provide an overall shell structure. Typically, overhead sound reflective ceilings are provided for such shells. The following listed patents, which I incorporate herein by reference, disclose various portable sound shell units:

| | |
|---|---|
| 2,671,242 | Lewis |
| 3,007,539 | Brewer et al |
| 3,180,446 | Wenger |
| 3,232,370 | Jaffe |
| 3,435,909 | Wenger et al |
| 3,630,309 | Wenger et al |
| 3,975,850 | Giaume |
| 3,908,787 | Wenger et al |
| 4,108,455 | James |
| 4,278,145 | Eade et al |
| 5,069,011 | Jenne |
| 5,168,129 | D'Antonio |

In many of the prior art structures, caster wheel assemblies have been fixed to the panel modules themselves, with certain disadvantages encountered as a result, including a requirement for undue storage space and distortion of the caster wheels which have to support the considerable weight of the panel modules in one position without rotating over a protracted period such as school summer vacation.

The present invention is concerned with acoustical shell tower and transporter systems and their components, the transporter component being useful for individually lifting the towers and transporting them between erected and stored positions, and for placing them in a unique nested stored configuration in which the transporter also is capable of nesting during storage.

SUMMARY OF THE INVENTION

The present invention discloses a shell tower and transporter assembly wherein a vertically elongate shell tower, comprising a central panel structure, hingedly connected along its side edges to edge or wing panels, has a horizontally extending wedge shaped skeleton base extending rearwardly from the acoustical panel which ,counterweights the central panel and edge panels. Vertically adjustable legs, with stage-engaging members mounted thereon, are provided on the tower, and a transporter, having a telescoping skeleton base supported on uniquely castered wheels, is configured to be received within each tower base. Provided on the transporter base are lifters with receptors for engaging the legs of the tower in lifting relationship, and an actuatable motor is provided for raising and lowering the lifters relative to the base supporting wheels, and, when raised, holding the tower in a raised transport position. In stored position, the tower wing panels are folded rearwardly, to be received in a nested relationship with the folded wing panels of other shell towers which requires much less storage floor space than previous structures, the bases fixed to the central panels being also received in nested relationship. The transporter is operable to raise each tower shell and transport it to storing position prior to lowering it again to the floor and disengaging to return to the shell and carry another tower to a nested position.

One of the prime objects of the present invention is to provide an improved shell tower panel structure which is readily assembled in modules to form an optimal acoustical shell which reinforces and blends the sound projected toward the audience, while also enhancing the ability of the musicians to hear themselves and adjust their performance accordingly.

A further object of the invention is to design a tower shell and transporter assembly which uniquely nests very compactly in stored position and can be moved rapidly and easily between assembly and storage positions so that set-up time is minimized.

Still another object of the invention is to design a assembly of the character described wherein a motor in the form of a hydraulic pump and cylinder assembly may be utilized on the transporter to lift the individual shell towers for transport.

Still another object of the invention is to provide acoustical towers with vertically adjustable tower legs which normally support the panel towers in plumb position on stage in properly aligned relation, and which function with a tower lifting transporter to facilitate the rapid erection and disassembly of the acoustical shell, and the movement of its tower components to and from stored position.

Still a further object of the invention is to provide a sound projecting acoustic shell which is stable when erected, which will adapt itself to various floor plan arrangements, and which is free standing on its own supports so as not to leave stumbling blocks on the stage.

Still a further object of the invention is to provide a modular tower and transporter system which can be economically manufactured, and which is durable in character and has a long and useful life.

Another object of the invention is to provide a acoustical shell which is so designed as to effectively control and reflect a maximum range of audible frequencies, and which is flexibly adjustable in size to accommodate varying performance group sizes.

A still further object of the invention is to design free-standing acoustical towers which are readily nested for storage without any need for dismantling them, and any need for the use of tools.

Still another object of the invention is to provide shell towers which are adjustable to compensate for minor level irregularities in the stage floor and wherein, at installation, are adapted to be located on target elements which are flush with the stage floor to indicate the proper position of each tower, and insure consistent shell erection in which each tower is placed in the same position each time.

Still another object of the invention is to design shell towers, having doors for entering and exiting the performing area, which can be safely handled when moved to and from storage and erected positions.

Another object of the invention is to provide tower shell transporter assemblies having special, low profile, orbiting and individually rotating caster systems which permit relatively effortless movement of the tower shells, and facilitate directional changes to move around obstructions as required.

Still a further object of the invention is to provide very attractive and strong tower shell panel systems with well protected, honeycomb cores.

Other objects and advantages of the invention will become apparent with reference to the accompanying drawings and the accompanying descriptive matter.

IN THE DRAWINGS

FIG. 7 is an enlarged, schematic top plan view thereof;

DESCRIPTION OF A PREFERRED EMBODIMENT

Figure 1:
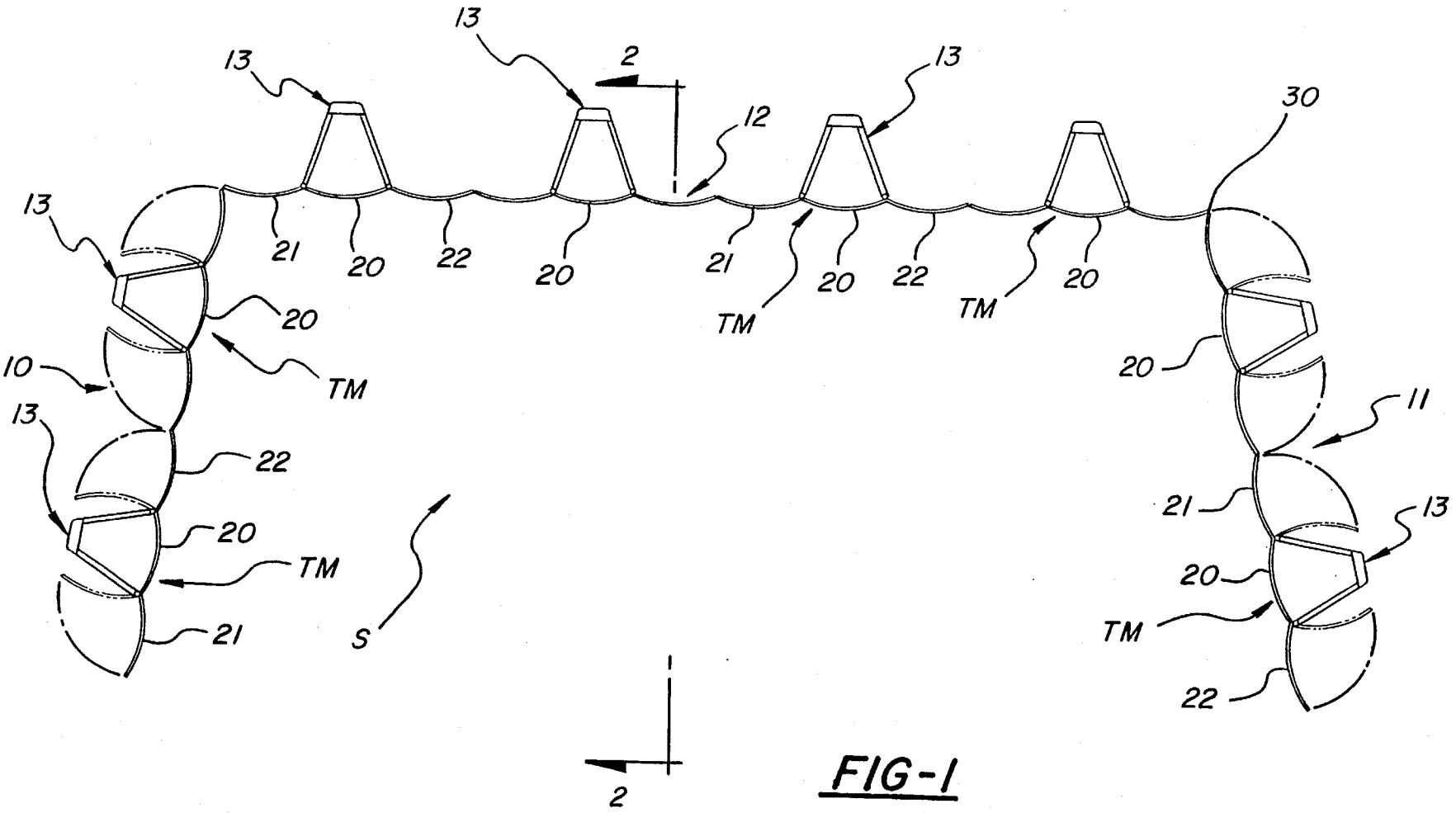
FIG. 1 is a schematic plan view illustrating the manner in which the module towers are assembled to form an orchestral shell.

Referring now more particularly to the accompanying drawings, the acoustical shell, generally designated S, which is assembled from the various modules to be described is illustrated as of generally U-shaped configuration in FIG. 1 to receive an orchestra or the like, and comprises side walls, generally designated 10 and 11, abutting a rear wall, generally designated 12. FIGS. 4–7 particularly illustrate a tower module or shell, generally designated TM, which can be moved into place adjacent other tower modules TM to form the side walls 10 and 11, and the rear wall 12. In FIG. 1, it will be noted that the side walls 10 and 11 are each made up of two modules TM, and the rear wall 12 is made up of four modules TM. Fewer or more modules can, of course, be employed in these walls as required, or the shell can have other configurations. Base frames, generally designated BF, for each module TM, have generally horizontally rearwardly extending wedge or tripod-shaped skeleton frame bases, generally designated 13, and upwardly extending bracing structure, generally designated **13*a*, provided to support the vertical panel assembly, generally designated PA, in upright position, base 13** being of suitable weight to counterweight the entire panel assembly PA.

Figure 5A:
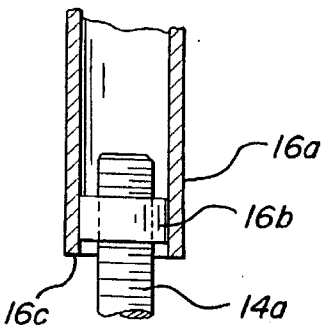
FIG. 5 is a schematic, end elevational view thereof.
Figure 15:
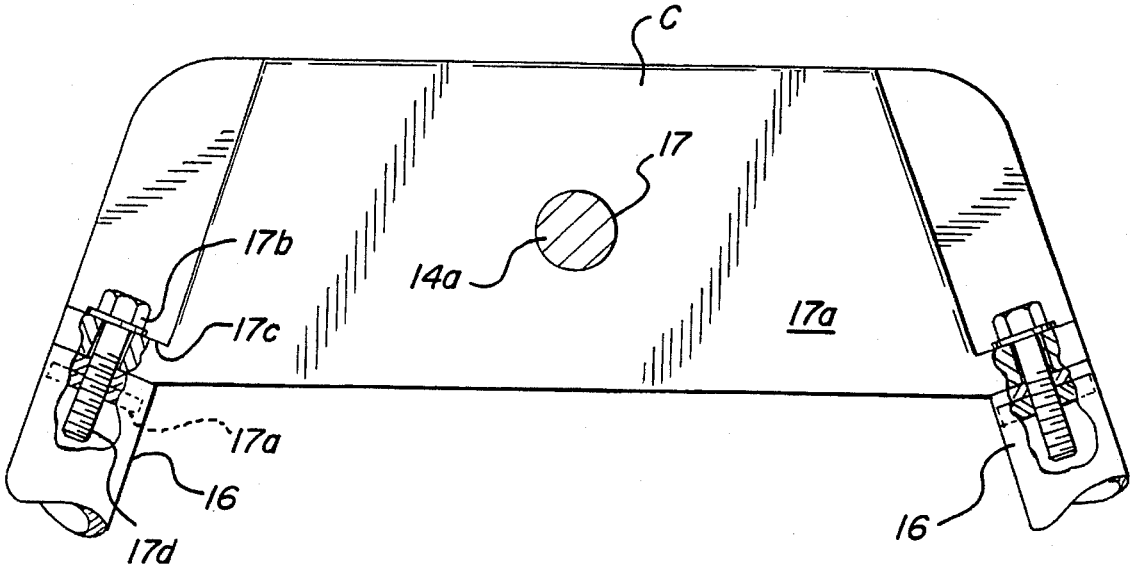
FIG. 15 is a fragmentary, under plan view on an enlarged scale showing the manner of attaching the counterweight forming the rear end of the tower base.

Arranged in tripod formation to support the tower module TM, are feet 14 on adjustable, tower-leveling threaded posts **14*a* which are individually adjustable vertically relative to the panel assembly PA and skeleton base frame 13 to accommodate to the usual level variations commonly to be found in stage floors. The frame portions 13 and 13*a* are made up of pairs of L-shaped pipe members 15 connected by a rear connector cast iron counterweight C to generally L-shaped pipe members 16. As shown in FIG. 15, nuts 17*a* can be welded in the ends of tubular members 15 and 16, and bolts 17*b*, can be bearing on counterweight flanges 17*c*, can extend into threaded openings 17*d* in the nuts 17*a* to secure the counterweight C. The members 15 and 16 are also connected by pipe braces 18 connecting their horizontal portions, and weldments 19 connecting their vertical portions 15*a* and 16*a*. The members 16*a* comprise tubular masts which extend from bottom to top of the panel assemblies PA, and the members 15*a* comprise tubular brace posts which extend upwardly as far as the upper end of an intermediate panel part 20*b*. As FIGS. 5A and 15 illustrate, the front legs 14*a* are threaded into nuts 16*b*, welded within the lower ends of the tubular masts 16*a* just above the lower surfaces 16*c* of masts 16*a* at the front of the tower, and the rear leg 14*a* is threaded into threaded openings 17 provided laterally centrally in the bottom wall 17*a*** of the counterweight C.

Each panel assembly PA (see FIGS. 4 and 6) includes a forwardly bowed, concavo-convex central panel, generally designated 20, which is hingedly connected at its side edges to forwardly bowed concavo-convex edge or wing panels, generally designated 21 and 22. The panel structure 20 in the Figures indicated is made up of superposed sections **20*a*, 20*b* and 20*c*, releasably secured together by metal fasteners F. Edge panel 21 has two superposed panel sections 21*a*, 21*b*, connected by fasteners F, and a lower panel 21*c* which serves as a stage access door. Likewise, edge panel 22 has an upper panel section 22*a* connected by fasteners F with an intermediate panel section 22*b*, above a lower door section 22*c*. Doors 21*c* and 22*c* are hingedly connected to the central panel section 20*c* in a manner to be described. It is to be understood that, typically, the module depicted in FIGS. 4 and 6 may be 22 feet or more in height, and that panel assembly PA may be 12 feet or more in width. In FIG. 7, the door 21*c* is shown as swung open in broken lines, while the door 22*c* is shown closed. It is further to be understood that the entire edge panel assemblies 21 and 22 can fold rearwardly in the manner disclosed in FIG. 3 to assume a nested position. The structure permitting this will be presently described. In this nested stored condition, the base portions 13**, which are wedge-shaped, readily nest, as shown.

Figure 8:
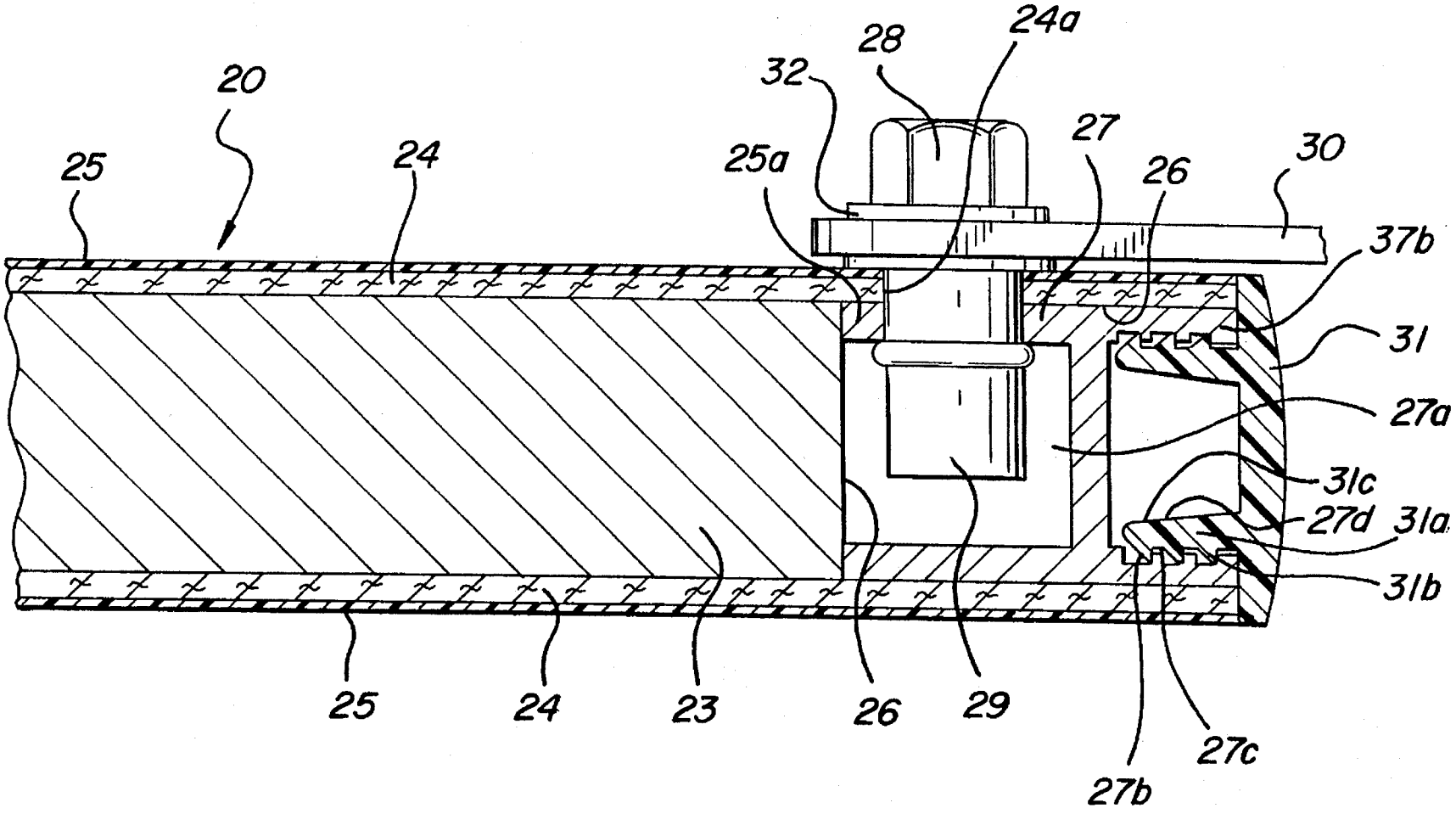
FIG. 8 is a partly schematic, enlarged, fragmentary, transverse sectional view through one of the panels of the tower structure to illustrate its construction, and its sound reflective and absorptive character.

In FIG. 8, we have shown a typical panel in cross section so that we can identify the various component parts thereof. It is to be understood that FIG. 8 illustrates the construction of the panels 20*a–c*, 21*a–c* and 22*a–c*. Each such panel shown as comprised of a cellulosic honeycomb cell core 23 secured within a hardboard casing 24, including opposite sides and a top and bottom. The structural casing 24 may be faced by a high pressure, plastic laminate, as shown at 25. It will be observed that the cell material 23 may be inset along its bottom, top, and side edges, as at 26 in FIG. 8, to receive an extruded aluminum H-channel frame 27, extending from top to bottom, which provides an open portion 27*a* for the reception of bolts 28 and then securing nuts 29. The bolts 28 secure hinge straps 30 or 30' securely to the H-shaped member 27. As shown, openings 24*a* are provided in the casing 24 and 25*a* in the members 25 to pass the bolts 28, which have washers 32. A plastic edge cover extrusion 31 has semi-rigid, resilient, divergent legs 31*a* with vertical ribs 31*b* which may be received in vertical grooves 27*b* provided in the interior faces of member 27, when flexible legs 31*a* are forced into position. Typically, the facing 25 may be formed of fire retardant, fiberglass reinforced plastic sheeting, and the core material 23 may comprise phenolic-impregnated craft paper. The hard board 24 may be a suitable plywood underlayment. Because all edges are of the same construction, save for the non-presence of the hinging structure where it is not required, a very rigid, yet light-weight, panel is provided.

Figure 6:
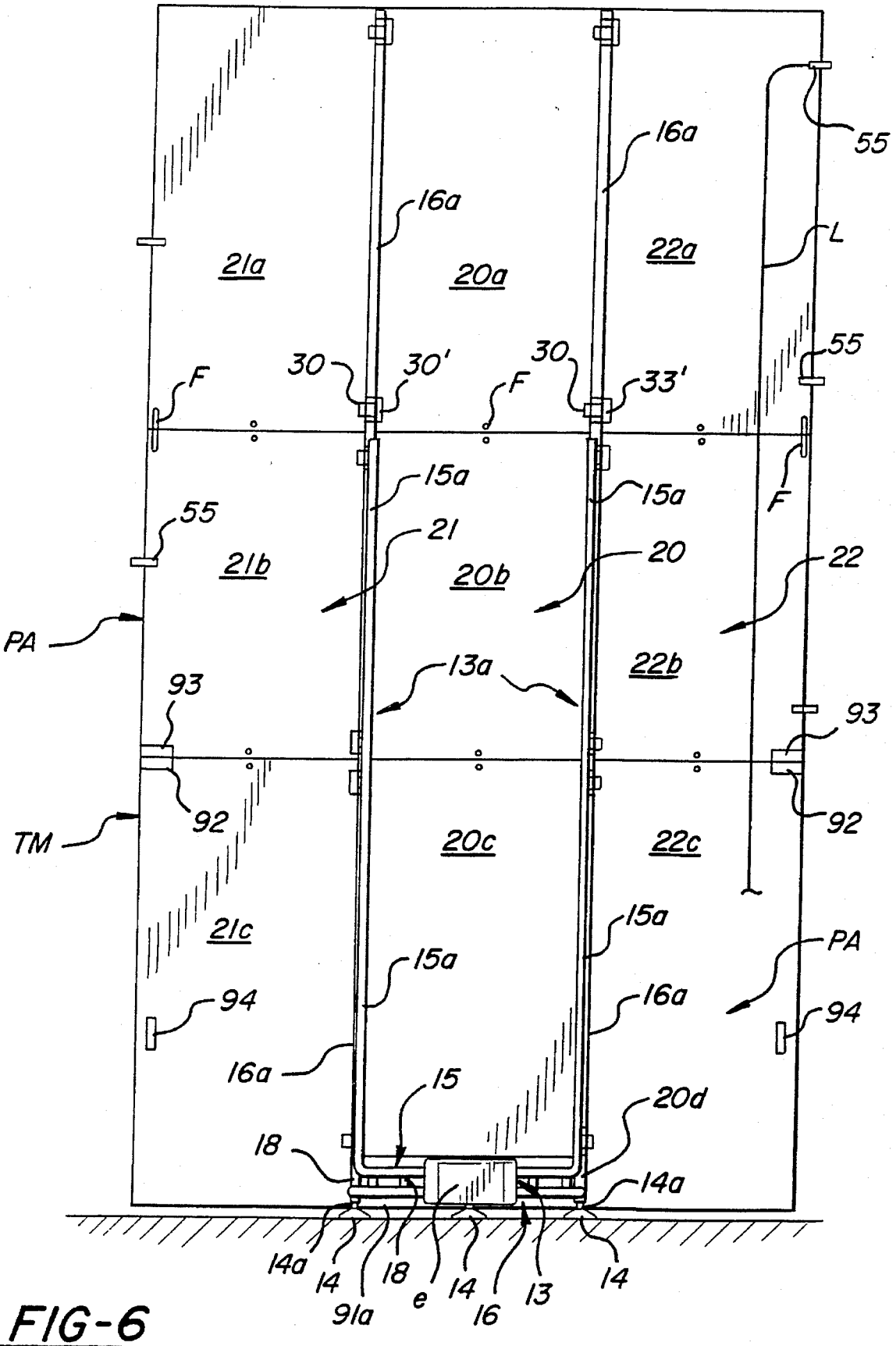
FIG. 6 is a schematic, rear elevational view thereof.
Figure 9:
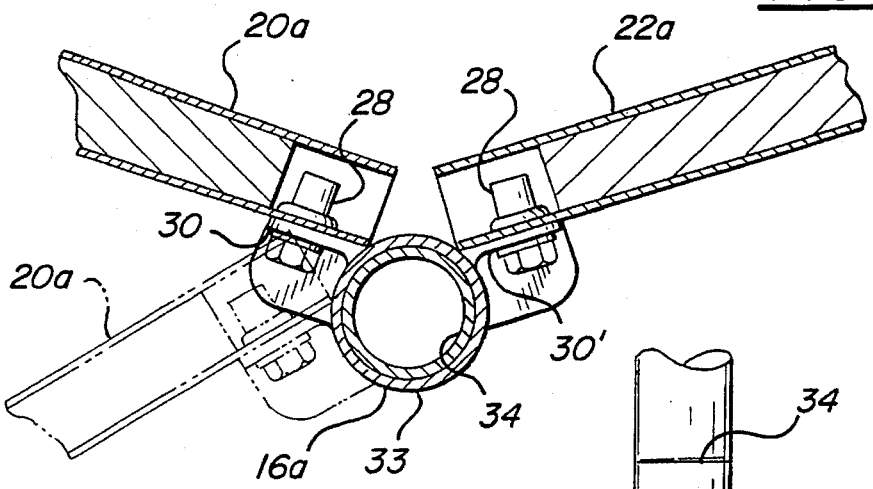
FIG. 9 is a schematic, enlarged, fragmentary plan view illustrating the panel hinging structure.
Figure 10:
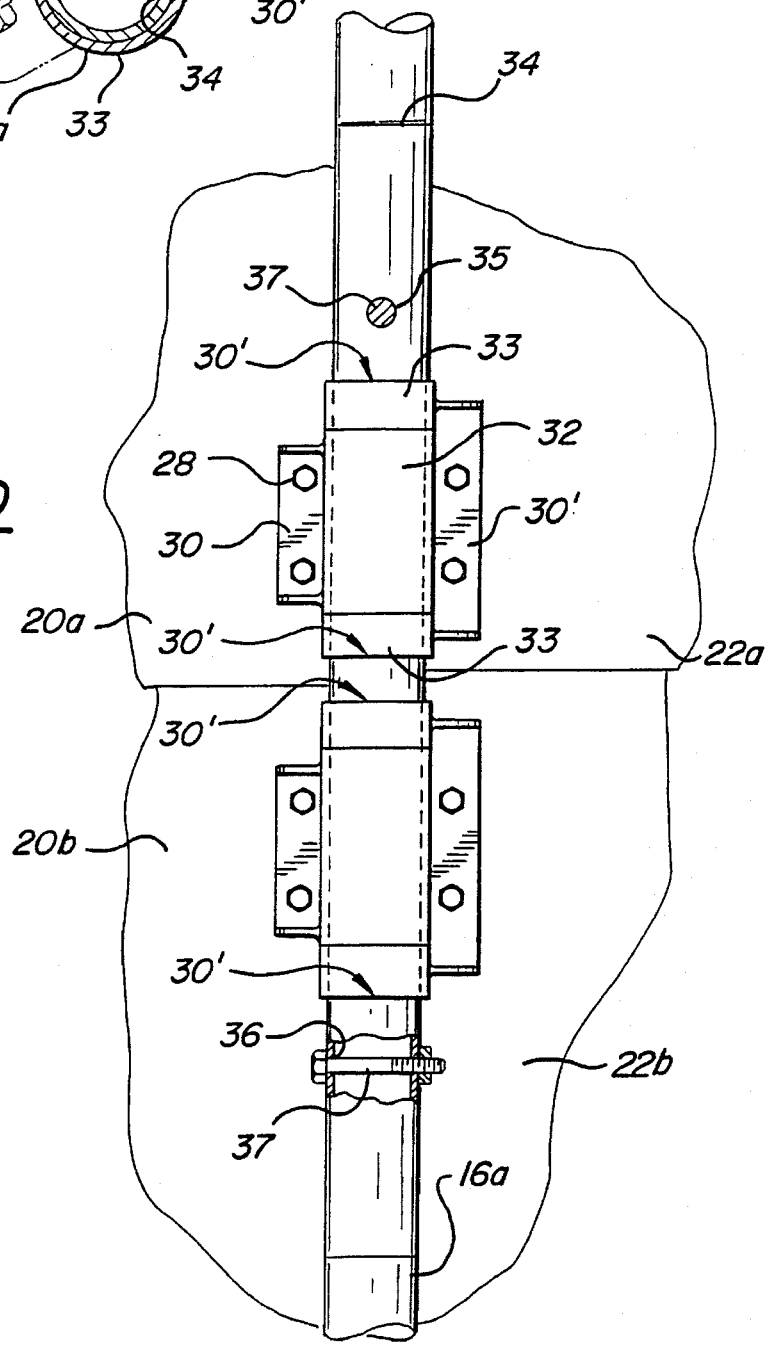
FIG. 10 is a schematic, fragmentary side elevational view thereof.

In FIGS. 9 and 10 the manner of hinging the wing panels to the central panel is more specifically illustrated, and it is to be understood that the same hinging construction that will now be described is provided in vertically spaced relation along the abutting edges of the central and wing panels, as illustrated in FIG. 6. Consequently, only one hinge structure need be described.

As shown in FIG. 10, each hinge strap 30 which is fixed to one edge of the central panel sections 20*a*, 20*b* or 20*c* is formed integrally with a sleeve 32 which is pivotally received on the adjacent mast member 16*a*. Each hinge strap for the adjacent panel sections 22*a–*22*c*, which is identified in FIG. 10 at 30' has integrated upper and lower rings 33 which are also pivotally received on the mast 16*a*, vertically on either side of the sleeve 32. It is to be observed that the hinge parts 30 are provided along the right edge of the central panel sections 20*a–*20*c* in FIG. 6 and the sections 30' are provided along the left edge of panel sections 22*a–c*. Panel sections 21*a–*21*c* have hinge plates 30 cooperating with hinge plates 30' along the left side edge of panel sections 20*a–c*. Because the hinges are integrated with the masts 16*a* in the sense that they rotate thereon, the hinging action is rigidly supported and functions stably with precision.

Provision is made for assembling or removing the upper section of the panel assembly PA, comprising sections 21*a*, 20*a* and 22*a*, as a unit, and for also removing the sections 21*b*, 20*b* and 22*b* compositely. As shown in FIG. 10, tubes 34 are welded in place inside the mast sections 16*a* in appropriate positions. Openings 35 are provided through the mast sections 16*a*, and aligned openings 36 through the tubes 34. Bolts 37 may extend through the openings 35 and 36 and, with the aid of nuts 38, lock the structure, to prevent the vertical sliding removal of the hinge sections off mast sections 16*a*. By removing the appropriate bolts 37 from mast sections 16*a*, the upper section 21*a*, 20*a*, 22*a*, and then the intermediate section 21*b*, 20*b*, and 22*b*, may be removed as a body from the upper end of mast sections 16*a*. When the full height of the panel assembly PA illustrated is not deemed necessary in a particular installation, upper section 21*a*, 20*a*, and 22*a* may be removed in the manner indicated, or only sections 21*b*, 20*b*, 22*b* and 21*c*, 20*c*, and 22*c* may be furnished, as in FIG. 14. The construction disclosed of course, also aids assembly of the panel assemblies PA in the first place, with the panel sections 21*b*, 20*b*, 22*b* being compositely mounted on the panel sections 21*c*, 20*c*, 22*c*, and then the panel sections 21*a*, 20*a* and 22*a* likewise compositely mounted on the mast sections 16*a* to complete the fabrication of the individual panel assemblies PA.

Figure 3:
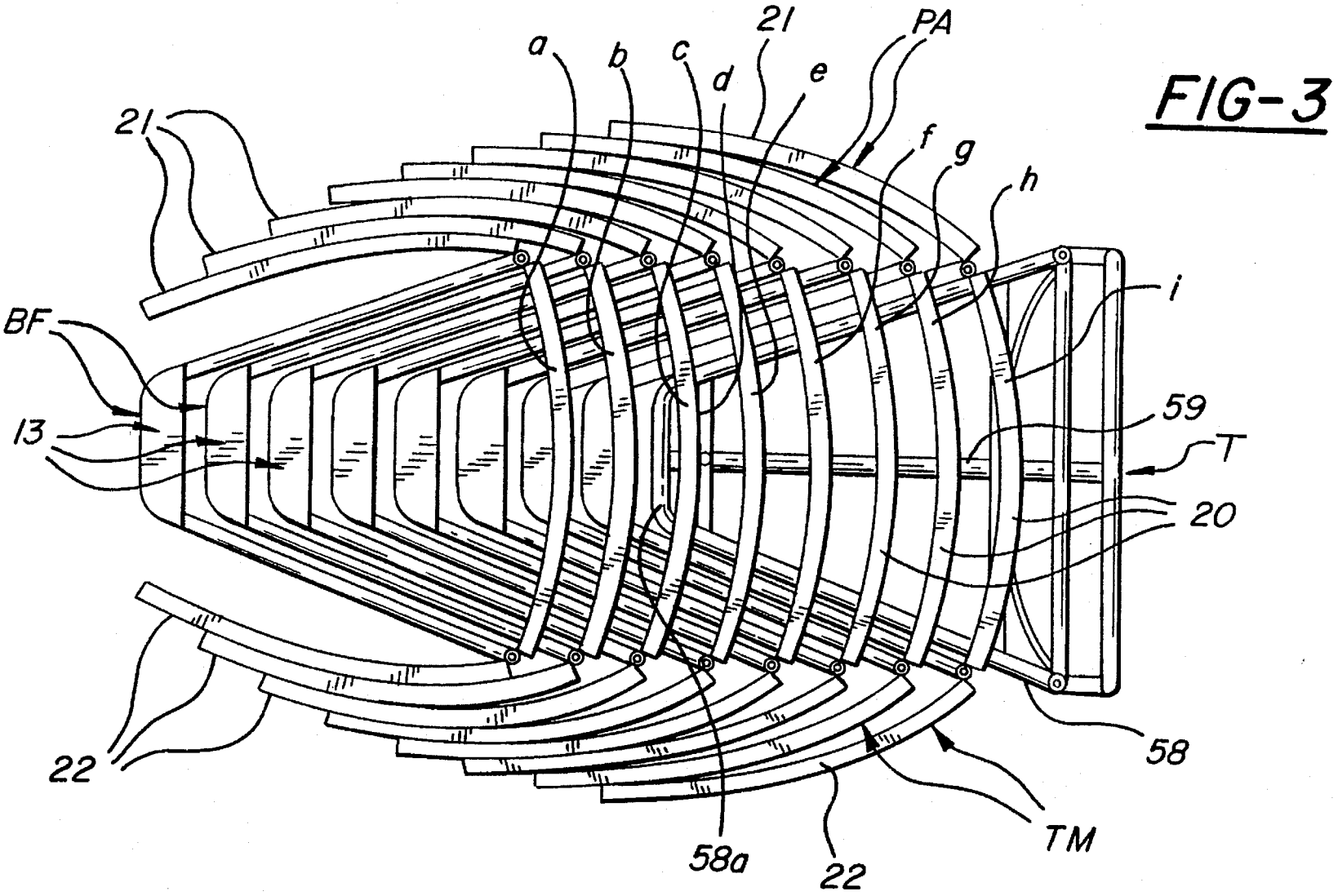
FIG. 3 is an enlarged schematic plan view illustrating the manner in which the various modules and transporter are nested in a stored position which requires very little storage space.
Figure 4:
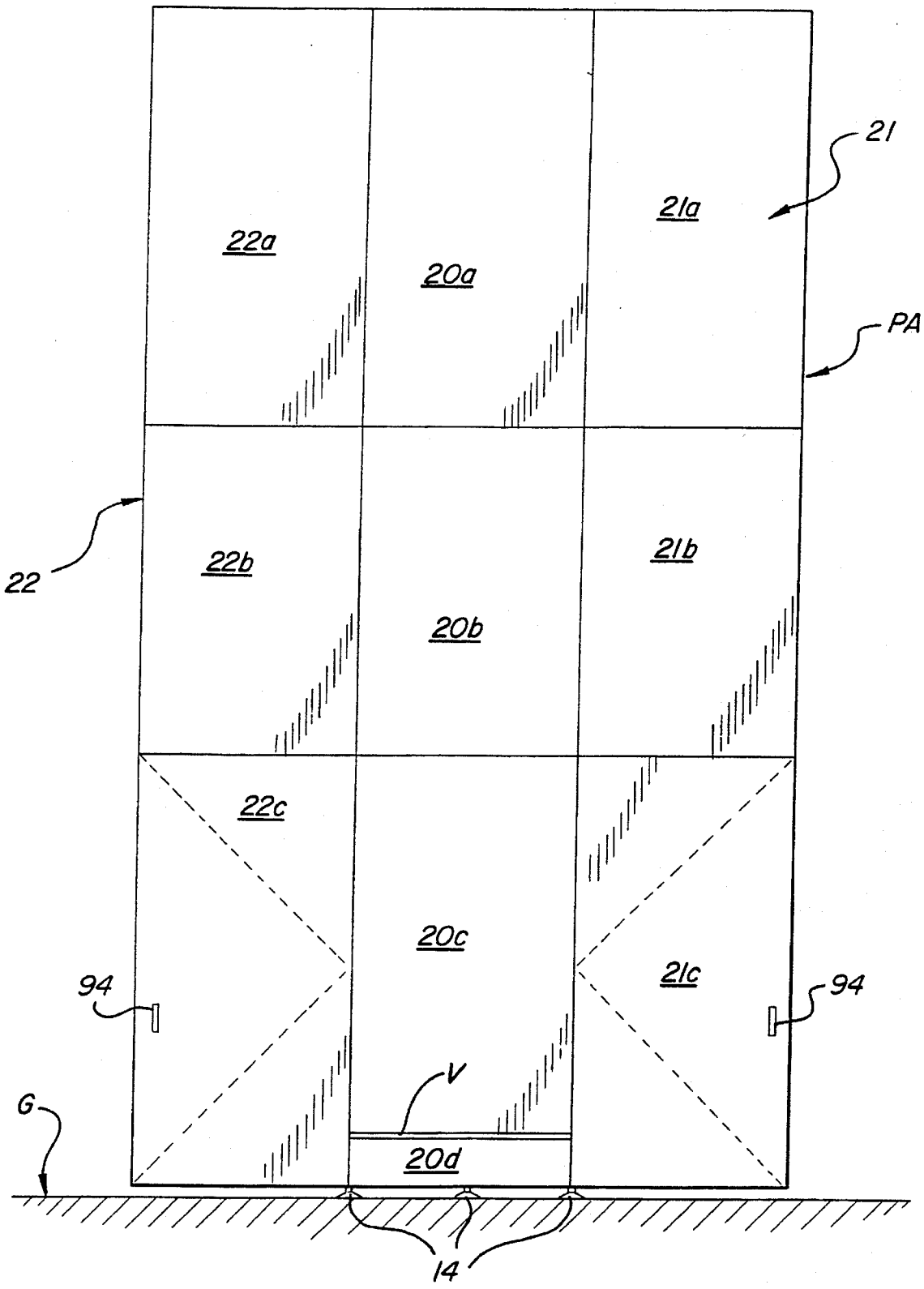
FIG. 4 is a somewhat schematic, front elevational view of one of the tower modules supported in upright user-position.
Figure 12:
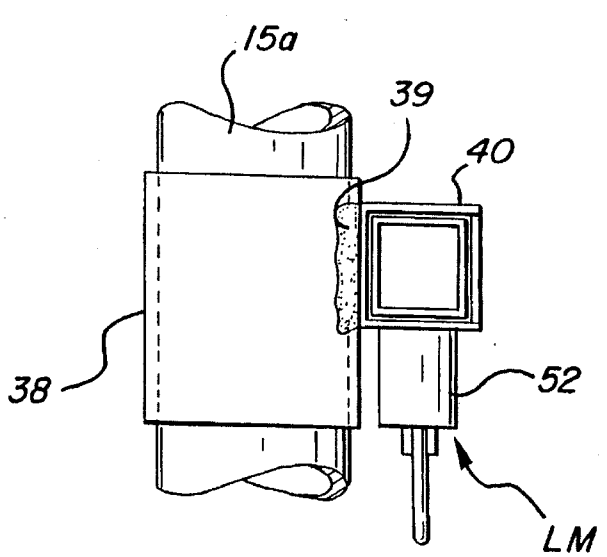
FIG. 12 is a sectional view taken on the line 12—12 of FIG. 11.
Figure 11:
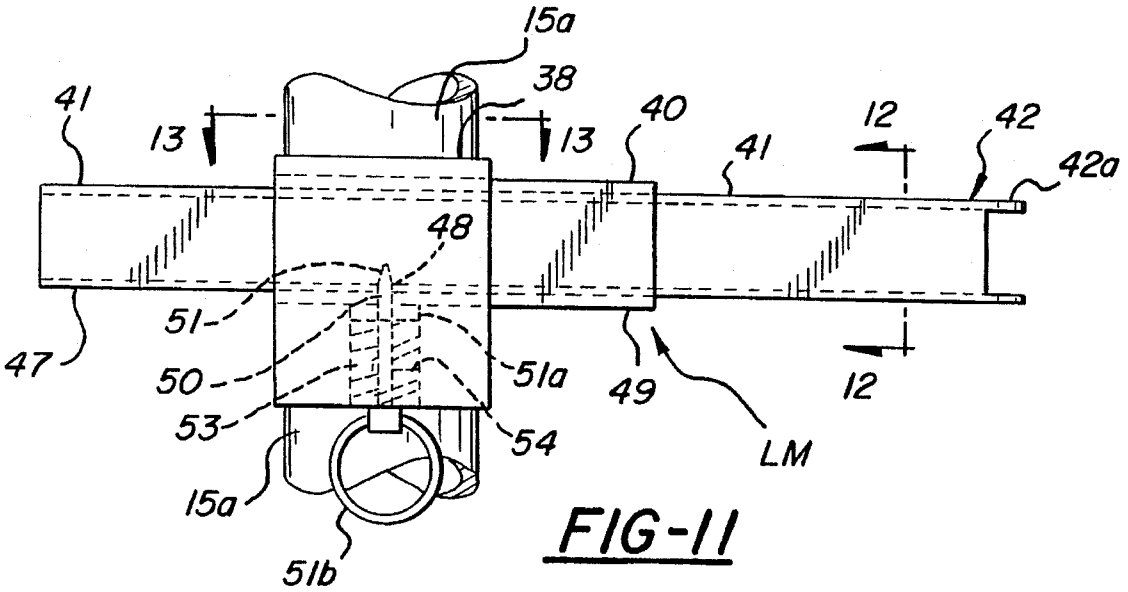
FIG. 11 is a schematic, enlarged, fragmentary side elevational view illustrating the assembly for locking the wing panel sections in various positions.
Figure 13:
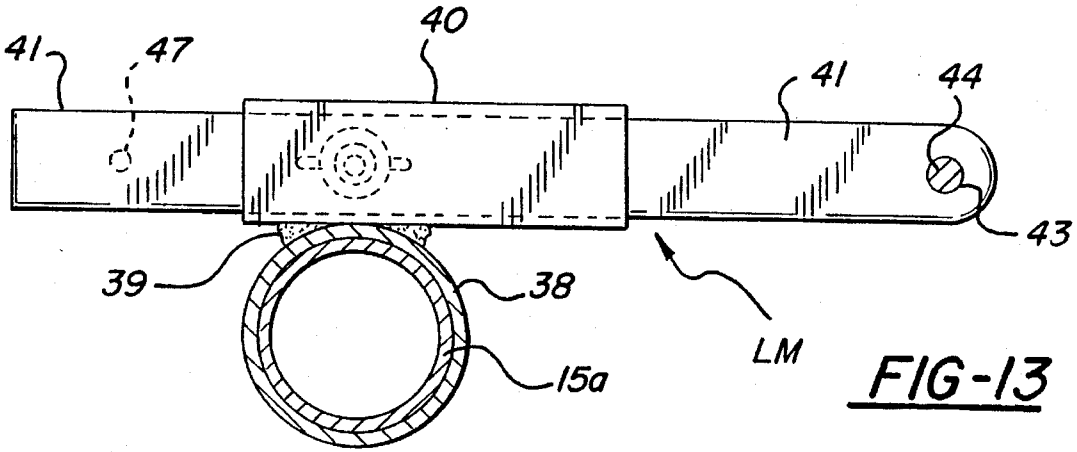
FIG. 13 is a top plan view taken on the line 13—13 of FIG. 11.

In FIGS. 11–13, we have illustrated mechanism, generally designated LM, for selectively locking the wing sections 21*a–*21*c* and 22*a–*22*c* in one of their three locked positions. In the so-called "user" position, the end panel sections 21*a–*21*c* and 22*a–*22*c* are locked in position in substantial planar alignment with the middle panel sections 20*a–*20*c*. The panel sections 21*a–*21*c* and 22*a–*22*c* are further foldable rearwardly to the position in which they are shown in FIG. 3, and provision is made to lock them in this position to provide nestability. Finally, to aid transport of the individual shell towers in a manner which will be presently described, the wing panel sections 21*a–*21*c* and 22*a–*22*c* are each foldable to an intermediate position, between the two positions mentioned, which better distributes the center of mass of the panel assemblies PA for transport to and from an erected and a stored position.

Figure 14:
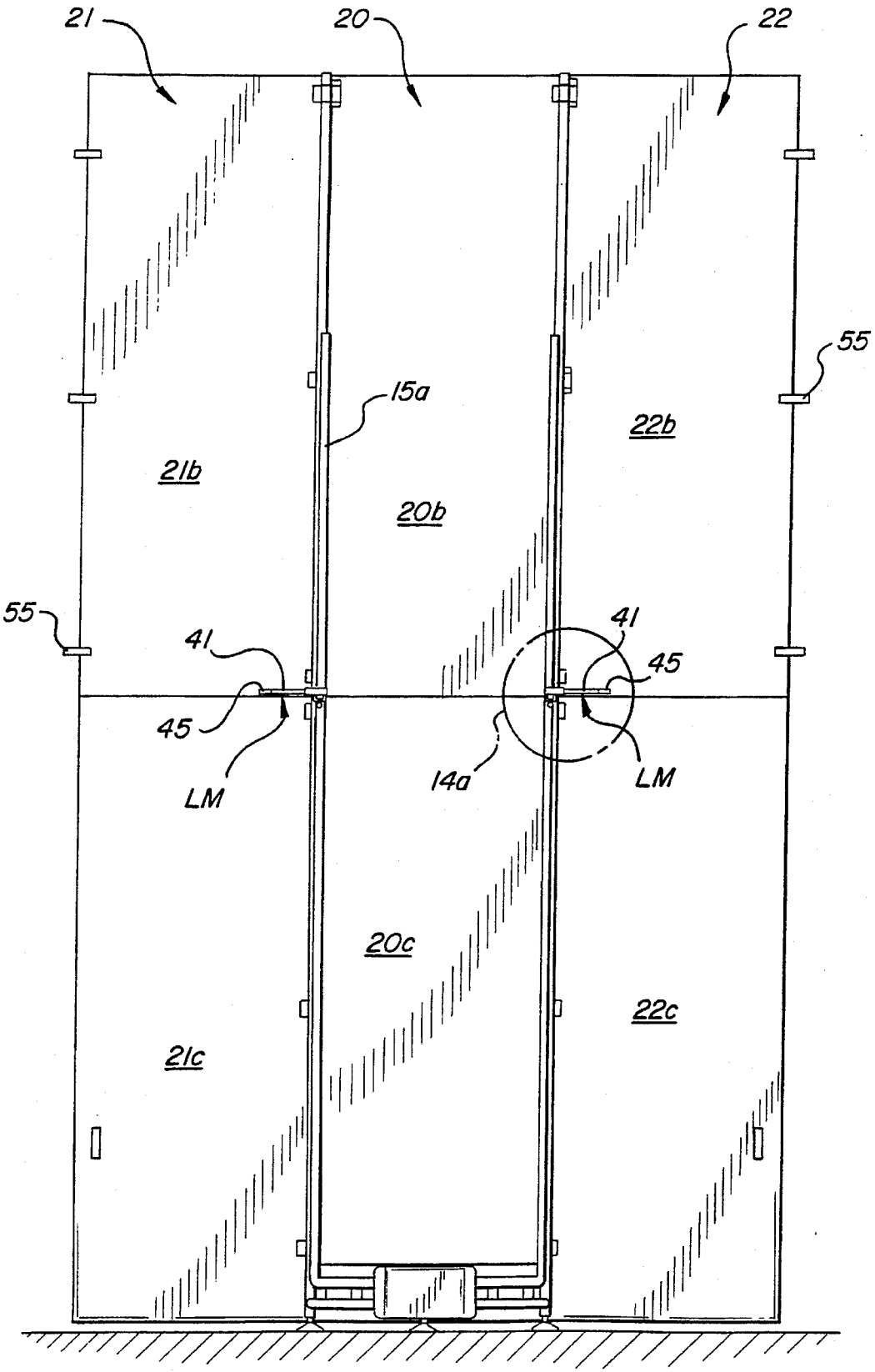
FIG. 14 is a schematic rear elevational view of a two tier tower module illustrating the positioning of the locking structure illustrated in FIGS. 11–13.
Figure 14A:
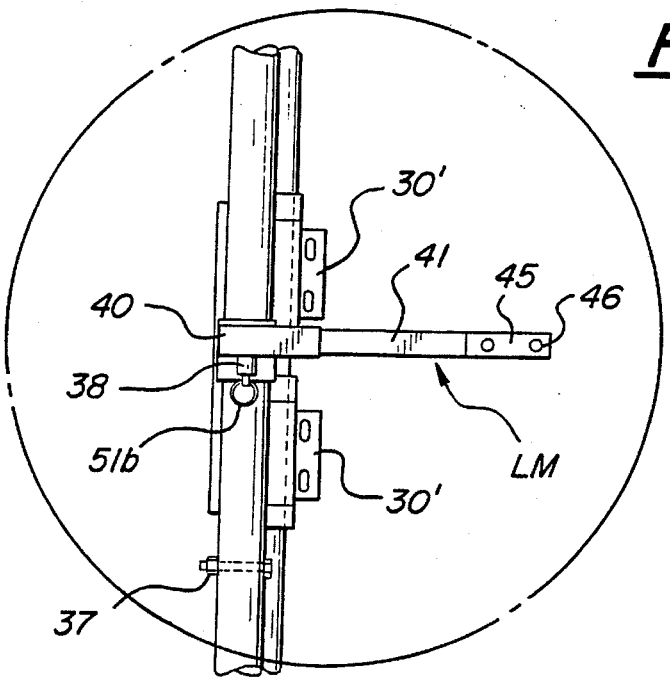
FIG. 14A is an enlarged spot view, the representation being of the rightmost spot and the additional chain line to the leftmost spot indicating that the mechanism remains the same but is reversed 90°.

While not shown in FIG. 5 and 6 in the interest of clarity, the wing panel lock members LM, illustrated in FIGS. 11–13, are disclosed in FIGS. 14 and 14A as extending between the vertical brace posts 15*a* on each side of the central panel 20*b* and each of the wing sections 21*b* and 22*b*. Each of the identical lock assemblies LM includes a sleeve 38 which is rotatably received on one of the brace pipe sections 15*a*. Welded to the sleeve 38, as at 39, is a tubular sleeve of rectangular cross-section 40, within which a tubular shaft of rectangular cross-section 41 is telescopically received. The outer end of shaft 41 is clevised as at 42, and the clevis legs 42*a* are provided with openings 43 to receive vertical pins 44 which are carried by a strap 45 (FIG. 14A), which may be bolted as at 46 to the wing section 22*c* or 21*c*, as the case may be. The shaft 41 is provided with a set of longitudinally spaced apertures 47, 48 and 49. Likewise, sleeve 40 is provided with an opening 50 to pass a spring-pressed pin 51. For example, a housing 52, secured to sleeve 40, may have a spring well 53, through which the pin 51 vertically centrally passes, and it will be noted that the pin 51 carries a plate 51*a* which is urged upwardly by a coil spring 54 in a state of compression. To facilitate removal of the pin 51 from one of the openings 47–49 provided in the tubular shaft 41, a pull ring 51*b* is attached to the outer end of pin 51, as shown.

In FIGS. 11–13 the pin 51 is shown as extending through the opening 48 in the sleeve shaft 41, and so is locking the wing section, to which shaft 41 pivotally attaches, in a partially folded or intermediately folded position between the user position of the panel assembly, when the wings are virtually in alignment with the central panel, and the folded storage position shown in FIG. 3. When the pin 51 on each of the lock assemblies LM is extending through openings 41, the two wing panels 21 and 22 on either side of the central panel 20 are locked in the user position illustrated in FIG. 1. When the pins 51 extend through openings 49, the panel wings 21 and 22 are folded to the FIG. 3 position and locked in that position. Because the locking mechanism is pivotal on the frame post structure and integrates with it, a more rigid, smoother operating lock can be achieved.

It is further to be noted that each panel assembly PA at the outer edges of its wing panels 21 and 22 has spaced apart alignment brackets 55. These are useful for lashing the respective shell towers together at their side edges, when it is desired to do this.

In FIGS. 16–19 we have shown the transporter, generally designated T, which is a component of the shell tower-transporter assembly, as having a horizontally forwardly extending, skeleton base frame, generally designated 56, which is wedge-shaped in plan view and configured to be received by the base 13 of each shell tower or tower module TM. Provided at the rear end of the base frame 56, is an upright bale-shaped handle 57 having a crossbar 57*a*, and legs 57*b* which are integrated with upper and lower convergent side pipe sections 58 and 59 which are respectively connected at their front ends by integral upper and lower cross portions 58*a* and 59*a* respectively. The convergent pipe sections 58 are also connected by front and rear brace sections 60 and 61 respectively, as shown, and the convergent pipe sections 59 are further connected by a brace section 62.

Figure 16:
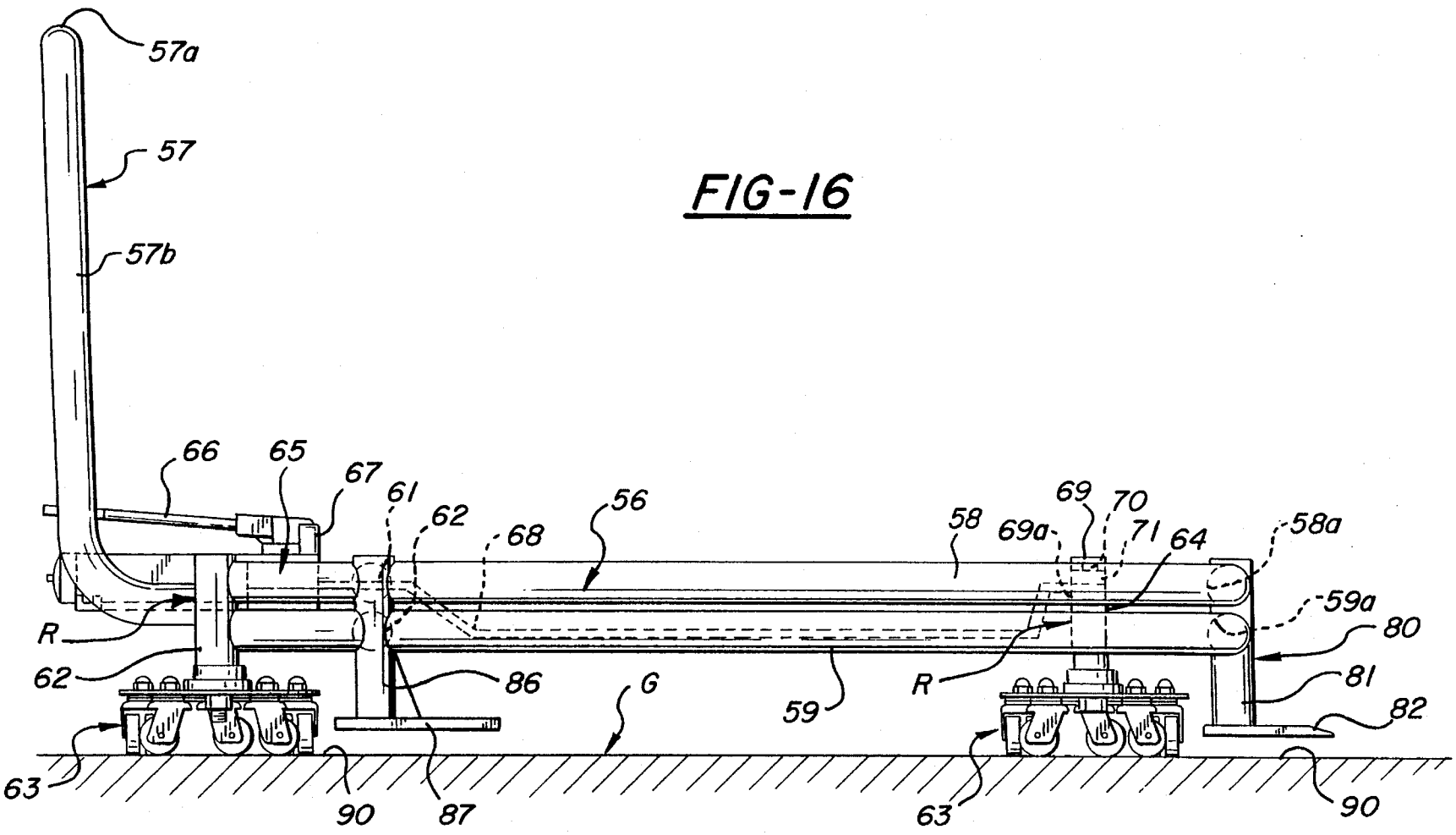
FIG. 16 is a partly schematic, side elevational view of a transporter.
Figure 17:
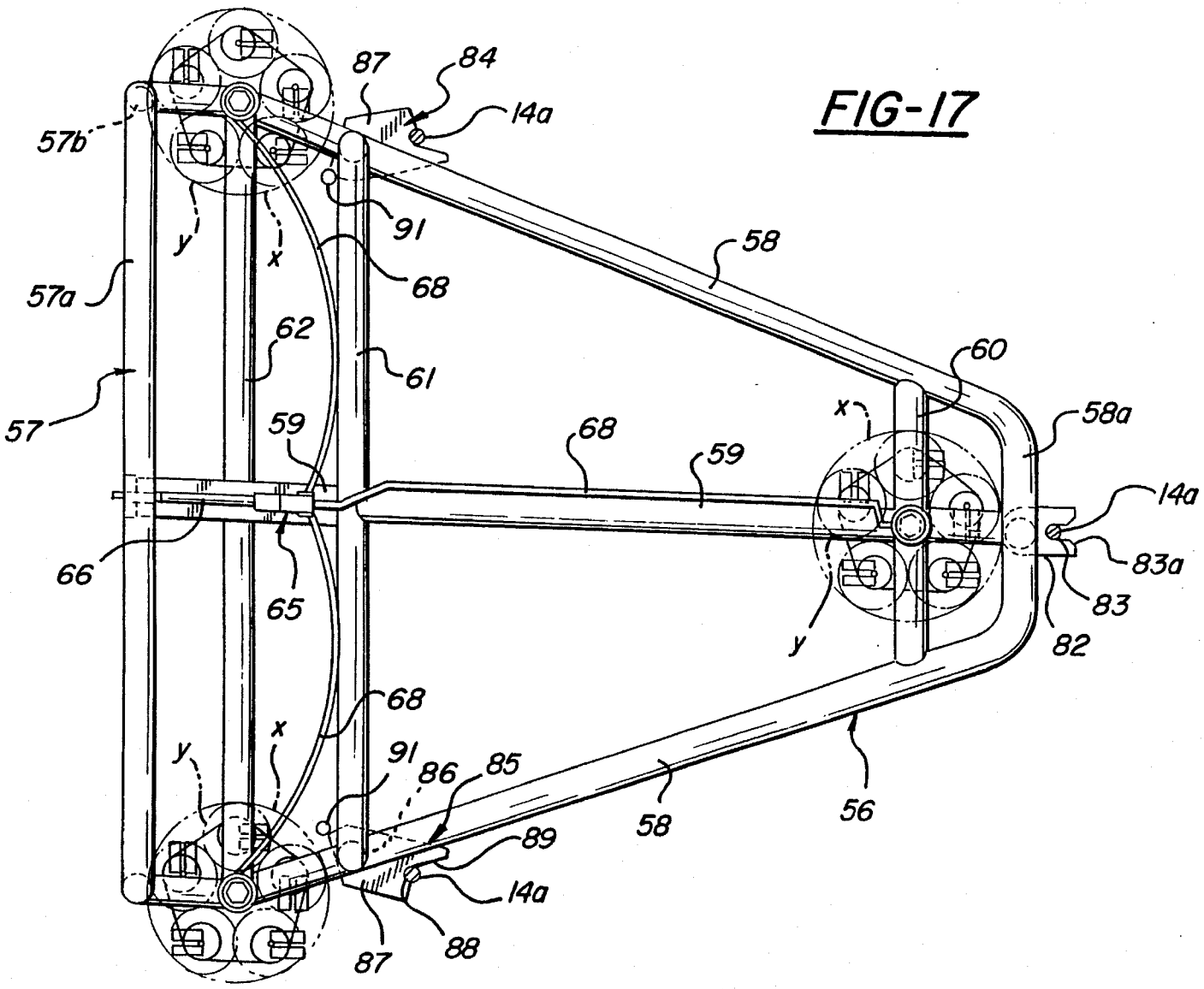
FIG. 17 is a partly schematic, top plan view thereof with only the legs of a shell tower shown in the received position in the receptor lifters of the transporter.
Figure 18:
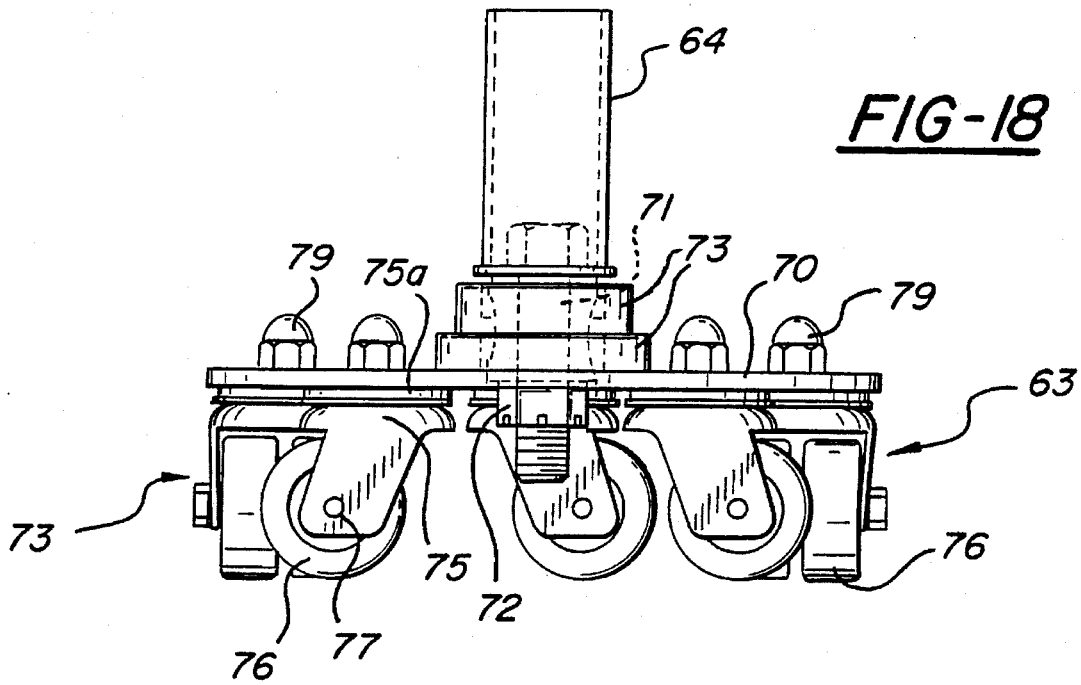
FIG. 18 is a schematic, fragmentary elevational view illustrating the caster assemblies for the transporter component.
Figure 19:
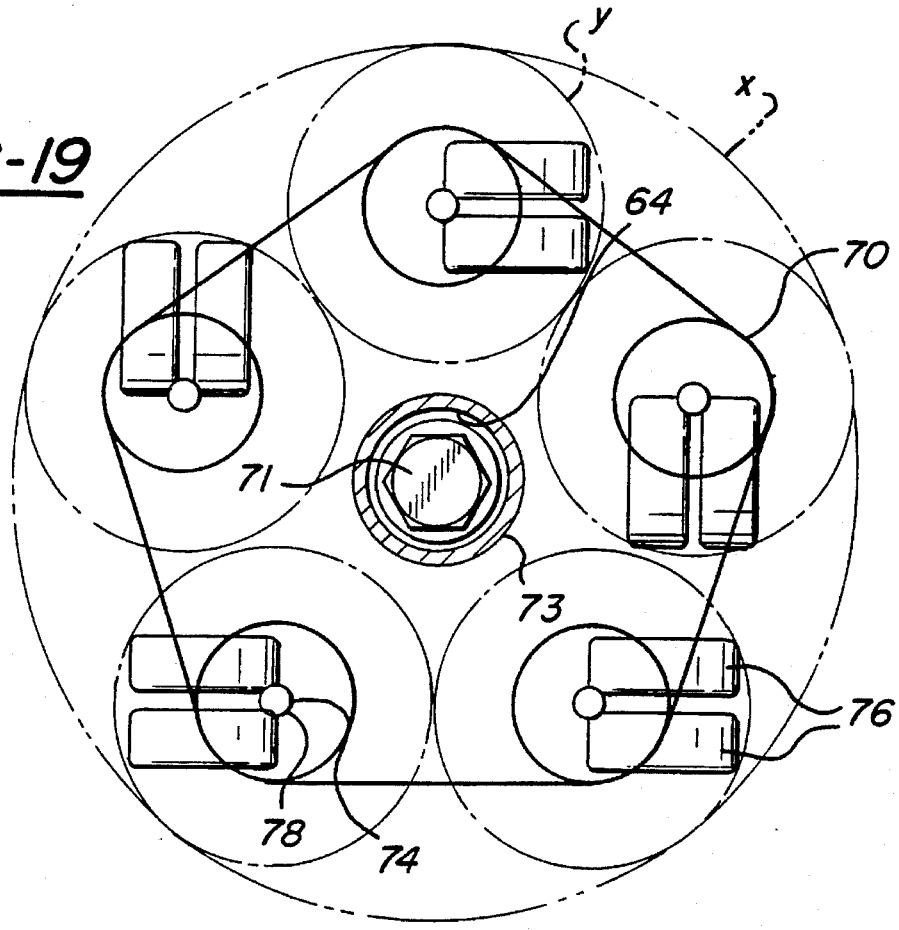
FIG. 19 is a schematic top plan view thereof.

Provided in tripod formation to support the transporter 56 for travel are unique caster assemblies, also termed caster pods or castered carriages and generally designated 63, which are more specifically illustrated in FIGS. 18 and 19. The caster assemblies 63, which support transporter T for travel on the stage floor, include hydraulic cylinder swivel stems 64 forming part of ram mechanisms which are generally designated R. The rams R are powered by a manually actuated hydraulic pump, generally designated 65, having an operating handle 66 pivoted thereto as at 67. The hydraulic pump can be an Enerpak pump, or another commercially available pump, which is capable of lifting a thousand pound shell tower. Hydraulic fluid expressed through hydraulic lines 68, leading from pump 65 to the cylinders 64 through a valve system, also connected to the pump reservoir, can power the trio of ram mechanisms simultaneously to raise or lower the base frame 56 with respect to stage or ground level G. Fixed on the base frame structure 56, and forming part of ram mechanism R, are cylinder shell members 69 which receive the stem cylinders 64 and have dependent parts 70 mounting axially fixed pistons 71 within the cylinders 64. As shown in FIG. 17, a pair of the members 69 are fixed to the members 62 at the rear of the transporter T, and a front piston member 69 is fixed to the cross brace 60 at the front end of the transporter T. Thus, when fluid is simultaneously pumped into the cylinders 64, via lines 68, the pistons 69 will be forced to the position shown in FIG. 16. In FIG. 16, the frame structure 56 is shown in its most raised position, which is the tower shell transport position. The egress of hydraulic fluid from the cylinders 64 when the operator manipulates the cylinder bleed valving lowers transporter frame 56.

As FIG. 19 illustrates, the ram cylinder 64 for each caster assembly 63 is rotatably secured to a caster plate 70 by a king pin 71 and nut 72. Bearings 73 on support element 73*a* rotatably support the pin 71 and lower end of cylinder swivel stem 64 for free pivoting movement. Provided in circumferentially spaced relationship on the plate 70 are a quintette of dual wheel casters, generally designated 73, on rotatable shafts 74 extending upwardly from the top covers 75*a* for the forks 75 which support the dual caster wheels 76 for castering movement via pins 77. The pins 74 extend freely up through openings 78 in the plate 70 and their ends may be covered by acorn nuts 79. With five dual wheel casters provided on each caster assembly there is so much contact with the stage floor that damage to the floor is avoided in the transport of the towers.

Provided in tripod formation on the base structure 56 (see FIGS. 16 and 17), are lifters for engaging the under surfaces 16*c* of masts 16*a* at the front of the shell tower and counterweight surface 17*a* at the rear. A front lifter, generally designated 80, includes a support post 81 and receptor plate 82 having a forwardly facing aperture recess 83 for receiving the rear leg 14*a* of the tower shell support feet 14. It should be noted that the marginal aperture surface of receptor 82 is inclined as shown at 83*a*, to pilot the lifter 80 with respect to leg 14*a*. It is to be further noted that the foremost receptor plate 82 is longitudinally centrally disposed. Rearwardly of the front lifter 80, are a pair of laterally spaced apart rear lifters, generally designated 84 and 85 respectively. The lifters 84 and 85 each include support posts 86 mounting receptor plates 87 which are inclined slightly laterally outwardly. The lifters 87 include forwardly facing laterally inclined, recessed apertures, generally designated 88, for receiving the legs 14*a* which are provided on each tower shell adjacent the panel assembly PA. The surfaces 89 which are inwardly inclined relative to the longitudinal axis of the frame serve, also, to pilot the receptors 87 to receive the front legs 14*a* for each shell tower. The post 81 for the lifter plate 82 secures to the front member 58*a* of the base frame structure 56, and the post 86 for the lifters 87 may be secured to the members 58 near their rear ends as shown in FIG. 17.

As shown in FIG. 16, pairs of bullseye targets 90, for each tower, may be recessed in the stage floor G so that the transporter assembly can bring the tower shell it is carrying to the exact position it should occupy when the orchestral shell is fully erected. This is accomplished by securing sight rings 91 to each of the lifters 84 and 85. The targets 90 and towers are numbered or color coded, so each shell tower TM is always erected in the same position. This is important because the feet 14 of the particular tower TM will have been relatively adjusted vertically to support that tower in plumb position for that stage location and re-leveling should never have to occur. It is important that a tower does not tilt to impose load on adjacent towers.

So that the transporter base structure 56 can enter into telescoping relation which each of the tower shell bases 13, a removable flap 20*d* which can be releasably attached using velcro strips V, is provided at the lower end of each central panel section 20*c*. The doors 21*c* and 22*c* of each of the panel assemblies PA may similarly be secured in closed position by velcro strips 92 at their upper ends interacting with velcro strips 93 provided on the above panel sections 21*b* and 22*b* respectively. Door handles 94 are further provided on the doors 21*c* and 22*c* on both sides for use as desired.

Figure 2:
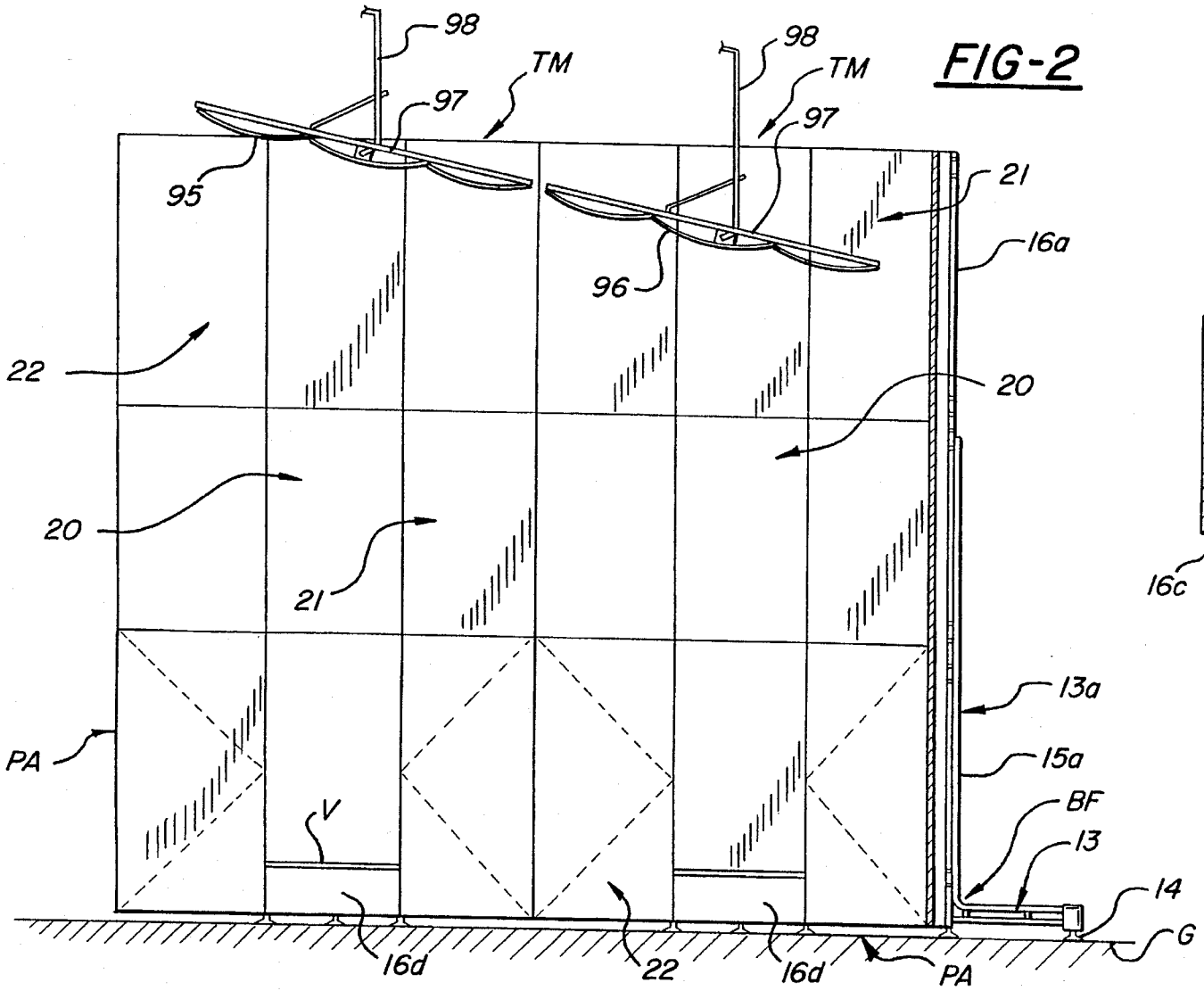
FIG. 2 is a transverse sectional view thereof, taken on an enlarged scale on the line 2—2 of FIG. 1.

In FIG. 2 we have shown acoustic ceiling panels 95 and 96 supported by frame members 97 on pivot rods 98. This ceiling structure is conventionally used and forms no part of the present invention. It is sufficient to understand that the panels 95 and 96 pivot on the members 98 into and out of user position.

THE OPERATION

Assuming now that the orchestra shell is set up in erected position and has been used, and it is now desired to remove it to stored position, it is necessary to first remove the flap panels 20*d* of each tower module TM, and to remove any lashing which may be used to secure the tower shells together in assembled relation. Further, the rings 51*b* need to be pulled to remove them from the user position openings 47, and the wing panels 21*a*–21*c* and 22*a*–22*c* then folded rearwardly with shaft tubes 41 sliding further into lock tubes 49 until springs 54 enter the pins 51 into the transport position openings 48 in lock tubes 49. This folding movement of the wing panels is easily accomplished because the shaft tubes 41 can readily pivot about the posts 15*a* and pins 44.

The transporter component T of the shell tower-transporter assembly is then moved to a centered position in front of the central panel structure 20*a*–20*c* of the first shell tower which it is to transport, and then is further moved forwardly with its wedge shaped member base 56 entering the opening formerly closed by the flap 20*d*. When the receptor plates 82 and 87 come into engagement with the front and rear legs 14*a*, as the transporter T is pushed forwardly with the lifter plates in lowermost position, the transporter T is piloted into aligned position by the aperture surfaces 83*a* and 89. Because the dual caster wheels can orbit about shell 84 in the circle E illustrated in FIG. 17 and each dual caster assembly is individually rotatable in a circle X, this is smoothly accomplished in an effortless manner. Actuation of the hydraulic cylinders 64 by manually operating pump 65 via pumping the handle 66, operates then to raise the base or carriage 56 and lifters 80, 84, and 85 relative to the caster assemblies 63, such that the tower shell is raised an inch or so to transport position. The receptor plates 82 and 87 rise to come into engagement with and raise the lower ends of mast posts 16*a* and the counterweight member 17, whose lower edge 17*a* is at the same level as the bottom edges 16*c* of masts 16*a*, to permit the lifting to take place. The transporter T then can be moved via handle 57 to transport the tower shell to a position adjacently opposite the location where the shell towers TM are to be stored in nested position. At this time, the rings 51*b* are again pulled downwardly, at the same time the wings 21*a*–21*c* and 22*a*–22*c* are folded further rearwardly, this folding causing both shafts 41 to further telescope into the housings 40. With rings 51*b* then being released, the pins 51 will enter the nested position openings 49, when permitted to do so, to lock the folded wings 21*a*–21*c* and 22*a*–22*c* in the nested position demonstrated in FIG. 3.

The shell tower TM can then be moved by the transporter to the position occupied by shell tower a in FIG. 3. At this point, the pump apparatus 65 is operated to bleed hydraulic fluid from the cylinders 64 so that it can return via the lines 68 to the pump reservoir. This lowers the base 56 and receptor plates 82 and 87 to a position in which they may be disengaged from the legs 14*a*, once the shell tower is lowered to the floor G. Following this, the transporter is moved rearwardly to disengage from the initial shell tower TM which has been transported, and returns to a position in front of the next shell tower TM to be transported. The process described is repeated until all of the shell towers a-i are deposited in the position shown in FIG. 3. The transporter T then lowers the last tower shell TM back to the floor, but remains in position nested with the tower shells a-i, ready to be used in the next erection process. When re-erection of the orchestra shell is to begin, the transporter T is already in position, and it is merely necessary to actuate the pump 65 to raise the transporter lifter plates 82 and 87 raise the legs 14*a* of the tower shell i once again. Before, or after, this raising movement, the wing panels of the tower shell i are returned to the transport position by again pulling the rings 51*b* to remove the pin 51 from the nested position openings 49, and swinging the wing panels 21*a*–21*c* and 22*a*–22*c* of the tower shell i to the transport position. As this swinging movement takes place, the rings 51*b* are released and the tubular shafts 41 are withdrawn from the lock housings 40 sufficiently so that the released pins then automatically engage in the transport position openings 48. In this position, the transporter brings the tower shell i to a position in which its sight rings 91 are directly over the particular bullseye targets 90 for the tower shell i. The pump valving is then operated to bleed hydraulic fluid from the cylinders 64 and the feet 14 of the tower shell i are lowered to the exact position in which they need to be located to reform the orchestra shell assembly. Transporter T can then be moved rearwardly to disengage from the tower shell i, and the rings 51*b* can be pulled following which the wing panels 21*a*–21*c* and 22*a*–22*c* of the tower shell i can be swung to the user position shown in FIG. 7. This movement of the wing panels further removes the shafts 41 from the lock housings 40 and, with rings 51*b* having been released, the springs 54 cause the pins 48 then to enter the user position openings 47. The transporter then returns to the nested stack shown in FIG. 3 and removes the next panels successively until all of the remaining shell towers h-a have been located in proper position with regard to the targets 90 to which they have been assigned. At this point, if it is desired to lash adjacent shell towers together, this may be accomplished with members 55 and a lashing line L to substantially eliminate any clearance spaces between the tower shells.

It is to be understood that the embodiments described are exemplary of various forms of the invention only and that the invention is defined in the appended claims which contemplate various modifications within the spirit and scope of the invention.

I claim:

1. An orchestra shell tower and tower transporter apparatus, comprising:

(a) a vertically elongate tower comprising a central panel, with front and rear surfaces, hingedly connected along its side edges to edge panels, the panels being formed of material permitting said tower to be sound reflective;

(b) a generally horizontally extending, open skeleton base for the tower extending rearwardly from the lower end of the central panel and counterweighting said central panel and edge panels;

(c) legs on said tower with stage engaging members thereon;

(d) a transporter, having a forwardly extending base, supported for travel on wheels and configured to be telescopically received within said base of the tower;

(e) vertically movable lifters on said transporter base having receptors engaging said tower in lifting relationship; and (f) actuatable power operated motor means for raising said lifters and thereby said tower relative to said transporter base supporting wheels, and supporting said tower in raised relationship for travel.

2. The apparatus defined in claim 1 wherein said lifters comprise members depending from said base; and said receptors comprise forwardly open-ended converging recesses in said lifters for receiving said legs.

3. The apparatus of claim 2 wherein said legs depend from said tower base, at the side edges of said central panel and from the rear end of said tower base, in triangular formation; and said lifters are provided, in the same triangular formation, at the front end of the transporter base and at the rear end thereof, in a position of alignment with said legs, to simultaneously receive said legs in the receptors.

4. The apparatus defined in claim 1 wherein said transporter wheels are mounted on caster wheel carriages, and said motor comprises vertically disposed hydraulic cylinders connecting each of the wheel carriages with the transporter base, and a hydraulic pump assembly carried on said transporter base and connected to operate said hydraulic cylinders.

5. In a transporter for use in erecting an orchestra shell made up of side by side shell towers, the towers comprising main panels with hingedly connected edge panels which, in user position, are in generally planar alignment with the main panels, the main panel of the towers having a generally horizontally rearwardly extending base fixed to the lower end of the main panel and there being feet provided on the base for supporting the tower;

(a) a forwardly extending skeleton base supported on caster wheel pods and configured to be received within the bases of the towers;

(b) vertically movable lifters with receptors for engaging a tower in lifting relationship, supported on said transporter base;

(c) actuatable motor means in axial alignment with each of said caster pods disposed between said base and caster pods for raising and lowering said tower and said lifters with respect to said pods; and (d) mechanism for powering said actuatable motor means to raise said lifters and receptors, and thereby a tower received by said receptors off the floor.

6. The mechanism of claim 5 wherein said tower bases have legs connecting the tower feet to the tower base and said receptors have sockets in predetermined formation for simultaneously trapping said tower legs in lifting relationship, said receptors having piloting surfaces for piloting the transporter to move said sockets into trapping engagement with said tower legs.

7. The transporter mechanism of claim 5 wherein said caster pods have at least five dual-wheel casters with vertical stems extending to an orbital caster pod member, said casters being individually rotatable about their stems and being orbital with said orbital member.

8. In a method of transporting towers, which in side by side relation make up an orchestra shell, to a storage position, the towers comprising sound reflective main panels with sound reflective edge panels connected along their edges, and which in user position are in generally planar alignment with said main panel, the main panels having generally horizontally rearwardly extending open bases with substantially in-line dependent legs adjacent both side edges of the main panel carrying stage engaging members thereon, there further being a transporter having a horizontally extending base, supported on wheels and configured to be received within the bases of the towers, the transporter base having fluid pressure operated, vertically movable lifters with receptors having sockets for engaging said tower legs in lifting relationship, the steps of:

(a) moving the base of the transporter into a sufficiently nested relationship with the rearwardly extending open base of a tower to thereby move the receptors into generally aligned relationship with the tower legs;

(b) piloting the transporter via the receptor sockets to engage the sockets with the legs in leg-trapping relationship;

(c) feeding fluid under pressure to raise said lifters substantially simultaneously, raising the lifters to lift the tower legs above the floor while the legs remain engaged in the receptor sockets;

(d) moving the transporter and lifted tower to a storage position; and (e) then removing said fluid under pressure to lower the lifters, and thereby lower the tower to the floor once again.

9. In a transporter for use in erecting an orchestra shell made up of side by side, shell towers, the towers comprising main panels with edge panels, the main panels of the towers having a generally horizontally rearwardly extending base fixed to the lower end of the main panel and there being feet provided on the base at each side of the main panels for supporting the towers;

(a) a forwardly extending unitary transporter base, with floor engaging caster wheels, configured to be received within the bases of the towers; and (b) vertically movable, fluid pressure activated lifters with receptors for engaging said feet in lifting relationship, supported for vertical travel by said transporter base for raising said lifters and tower with respect to said wheels.

10. The mechanism of claim 9 wherein said receptors have sockets in predetermined formation for simultaneously trapping said tower legs in lifting relationship, said receptors having converging piloting surfaces for piloting the transporter to move said sockets into trapping engagement with said tower legs.

11. In an orchestra shell tower and tower transporter apparatus comprising a vertically elongate tower having a central panel, with front and rear surfaces, connected along its side edges to edge panels, the panels being formed of acoustic material; the tower having a generally horizontally extending forwardly open base extending rearwardly from the lower end of the central panel and counterweighting said central panel and edge panels; base legs on said tower adjacent the sides of said central panel and having stage engaging members thereon; the improvement wherein a unitary transporter having a forwardly extended base supported for travel on wheels is configured to be telescopically receivable within the open base of the tower; and fluid pressure operated vertically moveable lifters with receptors are positioned on the base for substantially simultaneously engaging said tower legs in lifting relationship and raising and permitting lowering of a tower relative to said transporter base wheels.

12. The apparatus of claim 11 wherein said receptors comprise forwardly open ended converging recesses in said lifters for receiving said legs.

13. An orchestra shell tower and tower transporter apparatus, comprising:

(a) a vertically elongate tower comprising a central panel, with front and rear surfaces, connected along its side edges to edge panels, the panels being formed of acoustic material permitting said tower to be sound reflective;

(b) a generally horizontally extending, open base for the tower extending rearwardly from the lower end of the central panel and counterweighting said central panel and edge panels;

(c) legs on said tower rearwardly adjacent the sides of said central panel with stage engaging members thereon;

(d) a unitary transporter, having a forwardly extending base, supported for travel on wheels and having an end configured to be received by said open base of the tower;

(e) vertically movable lifters on said transporter base having receptors positioned on said base in planar relationship in a plane generally parallel to said central panel for substantially simultaneously engaging said tower legs in lifting relationship; and (f) an actuatable power operated activator movable upwardly for raising said lifters and legs conjunctively relative to said transporter base supporting wheels, and then supporting said tower in raised relationship for travel.

14. A method of constructing a transporter for use in erecting an orchestra shell made up of side by side shell towers, the towers comprising main panels with edge panels which, in using position, are in generally planar alignment with the main panels, the main panels of the towers having a generally horizontally rearwardly extending base fixed to the lower end of the main panel which are provided with feet at each side of the main panels for supporting each tower, the steps of:

a) providing a forwardly extending transporter base, with floor engaging wheels, configured to be received within the bases of the towers;

b) providing vertically movable, fluid pressure activated lifters having receptors for engaging said feet in lifting relationship, supported for vertical travel by said transporter base; and c) connecting a fluid pressure system to said base for lifting said lifters and tower with respect to said wheels.

* * * * *

UNITED STATES PATENT AND TRADEMARK OFFICE

CERTIFICATE OF CORRECTION

PATENT NO. : 5,530,211

DATED : June 25, 1996

INVENTOR(S) : Orley D. Rogers, James F. Jenne, Phillip R. Blaisdell

It is certified that error appears in the above-indentified patent and that said Letters Patent is hereby corrected as shown below: Title page:

Substitute the following abstract for the abstract presently of record:

-- ABSTRACT

An orchestra shell tower and tower transporter system has a plurality of shell towers comprising an acoustic central panel hingedly connected along its side edges to acoustic wing panels. A generally horizontally rearwardly extending, rearwardly open base is fixed to the lower end of the central panel and counterweights both the central panel and the wing panels. Vertically adjustable dependent legs with stage engaging members are provided on the tower. A tower transporter has a forwardly extending open base supported on caster wheels which is configured to be received within the base of each of the shell towers. Vertically movable lifters on the transporter base have receptors for engaging legs of the tower shells in lifting relationship and raising the tower engaged by the transporter

UNITED STATES PATENT AND TRADEMARK OFFICE

CERTIFICATE OF CORRECTION

PATENT NO. : 5,530,211

DATED : June 25, 1996

INVENTOR(S) : Orley D. Rogers, James F. Jenne, Phillip R. Blaisdell

It is certified that error appears in the above-identified patent and that said Letters Patent is hereby corrected as shown below:

for supporting the tower in a lifted position for travel.

Column 9, line 17, change "E" to -- x --; line 18, change "X" to -- y --.

Column 12, line 18, change "legs" to -- feet --; line 21, change "legs" to -- feet --. --

Signed and Sealed this

Twenty-second Day of October, 1996

Bruce Lehman

*Attest:*

BRUCE LEHMAN

*Attesting Officer*

*Commissioner of Patents and Trademarks*